United States Patent [19]

Campbell

[11] 4,320,881

[45] Mar. 23, 1982

[54] FAIL-SAFE DECODER FOR DIGITAL TRACK CIRCUITS

[75] Inventor: Richard D. Campbell, Swissvale, Pa.

[73] Assignee: American Standard Inc., Swissvale, Pa.

[21] Appl. No.: 193,765

[22] Filed: Oct. 3, 1980

[51] Int. Cl.[3] ..... B61L 21/00; G08C 19/28

[52] U.S. Cl. ..... 246/34 B; 246/34 R; 246/121; 340/825.64; 340/825.71; 371/22; 371/25; 375/10

[58] Field of Search ..... 340/171 R, 167 R; 246/121, 34 B, 34 R, 34 A, 34 CT, 122, 125, 128, 130, 167 R, 187 B, 5, 63 R; 371/22, 25; 370/10, 114

[56] References Cited

U.S. PATENT DOCUMENTS

| | | | |
|---|---|---|---|
| 3,599,154 | 8/1971 | Carol et al. | 324/161 |
| 3,992,698 | 11/1976 | Sahasrabudhe et al. | 340/167 B |
| 4,015,082 | 3/1977 | Matty et al. | 364/426 |
| 4,034,195 | 7/1977 | Bates | 371/25 |
| 4,081,160 | 3/1978 | Devy et al. | 246/63 C |
| 4,084,262 | 4/1978 | Lloyd et al. | 371/25 |
| 4,207,569 | 6/1980 | Meyer | 246/121 |
| 4,271,512 | 6/1981 | Lyhus | 371/25 |

*Primary Examiner*—James J. Groody
*Attorney, Agent, or Firm*—A. G. Williamson, Jr.

[57] ABSTRACT

A selected unique digital comma-free code word is transmitted through track section rails from one end and, when received at the other end, is applied serially to a shift register which supplies a parallel readout of shifting pattern to one input of a fail-safe comparator. The second comparator input is selected from the different possible digital code patterns of the track code word stored in a memory device. When inputs are equivalent, the comparator passes an input test signal to its output. Absence of comparator output causes the selected stored code word to be stepped through the stored patterns, in reverse order to track code shift, until equivalence is again obtained. The periodic output signals, of approximately 50% duty cycle, are processed through a series filter-rectifier network, tuned to test and periodic output signal frequencies, to energize a track relay to register an unoccupied track section indication.

13 Claims, 2 Drawing Figures

FAIL-SAFE DECODER FOR DIGITAL TRACK CIRCUITS

BACKGROUND OF THE INVENTION

The field of my invention relates to a fail-safe decoder for digital track circuits. More particularly, the invention pertains to fail-safe decoding apparatus for audio frequency track circuits in which a section-identifying comma-free code is transmitted through the rails of each section to provide train detection.

As more sophisticated train and/or traffic control systems are planned for railroads, the track rails, in addition to train detection and control, are used for communication purposes and information sources such as train-to-wayside communication and distance traveled or specific train location indications. Where alternating current track circuits are used, particularly in the audio frequency range, the amount of other apparatus connected to the railroad track may become so great that the track circuit transmitter carrier frequency alone cannot guarantee that a track receiver responds only to the correct transmitter. One possible solution is that each transmitter send a unique digital code capable of being detected only by its companion receiver. If there are 100 unique codes available, then the amount of apparatus connected to the track can be increased by about an order of magnitude over what can otherwise be safely used. One form which the transmitted digital codes may take is the so-called comma-free code (CFC) type in which each code comprises a continuouous and repetitive stream of digital bits (1 and 0) automatically divided into words without requiring word synchronizing signals. One definition of comma-free codes is that no overlap portion of two successive code words, even identical code words, can also be a separate code word. To meet these requirements, only a relatively few words are usable of the total combinations available in accordance with the selected word length, that is, the number of bits per word. The consequence of this is that all rotated versions of a selected code word are excluded from the dictionary of usable words but may be assigned the same meaning as the basic word from which they develop. For example, a practicable system using 10 bit words has only 99 usable comma-free words. If such codes are used in a track circuit arrangement, a failsafe decoder is then required at the receiver end of the section to assure that only the reception of the proper code word is registered as an unoccupied track section.

Accordingly, an object of my invention is fail-safe decoder apparatus for a digital code track circuit.

A further object of the invention is fail-safe decoder apparatus, for an n-digit code word track circuit, requiring reception only of n bits to determine a valid code.

A further object of the invention is decoding apparatus for a digital code track circuit in which a unique comma-free code of n-bit words transmitted through the rails of each section is registered to indicate an unoccupied condition of a corresponding track section.

A still further object of the invention is fail-safe decoding apparatus, for a track circuit in which an identifying comma-free code is transmitted through the rails, including a shift register for sequentially storing the received track code, a read only memory storing all possible bit patterns of the unique CFC word identifying that track circuit, and a fail-safe comparator sequentially comparing the received track code and successive words selected from the read only memory to assure reception of the correct track code through the rails.

Yet another object of the invention is decoding apparatus for assuring the reception of a correct identifying n-bit comma-free code word over a communication channel, including a register for sequentially storing and then supplying in parallel format the continuous CFC received over the channel, a read only memory means for storing a predetermined number of digital words equivalent to all versions of the comma-free code word identifying the channel, a fail-safe comparator for comparing each registered CFC pattern with successively selected read only memory words and which outputs a test signal only when a comparison is obtained, and a processing network for stepping the read only memory when no test signal output is obtained and for processing the periodic test signal output to register the reception of the correct CFC word over the channel.

Other objects, features, and advantages of the invention will become apparent from the following specification and appended claims when taken in connection with the accompanying drawings.

SUMMARY OF THE INVENTION

According to the invention, a transmitter having a selected frequency, preferably in the audio range, is coupled to the rails at one end of a railroad track section to transmit a selected n-bit comma-free code (CFC) word through the rails. The specific code word selected uniquely identifies the associated track section, distinguishing from other comma-free code words assigned to nearby rail sections. All such words have an equal number of bits but no conflicting overlap code combinations are utilized in the identifications. The codes are transmitted serially with the code pattern repeating after n-bits are transmitted, i.e., the selected word length. At the other end of the section, the receiver element, similarly tuned, is coupled to the rails and accepts the track code which is transferred to a shift register unit where it is serially registered but read out in a parallel or broadside digit format. This receiver also develops equivalent transmitter clock pulses to drive the shift register. As the code word bits are received through the track rails, the CFC word thus shifts through the register and the instant readout is any one of the possible comma-free bit patterns of the code word assigned to that section.

The parallel output of the shift register is applied to an n-bit comparator element whose second input for comparison comes from a read-only-memory (ROM) unit which stores a number of digital words, one for each different arrangement or pattern of the associated track section identifying CFC word. When the two input words at any instant compare, that is, have equivalent digits, an alternating current test signal input to the comparator is passed through the various stages or cells to the output. The output of the ROM unit is controlled by a word selector which, when activated, shifts the ROM output through a sequence representing the various digital versions of the track identity word. This selector is stepped by clock pulses applied through an AND gate opened or activated only when there is no comparator output. The ROM sequence is arranged to be in a reverse order to the transmission sequence of the track code word. Thus, when the registered track word pattern shifts, a period of non-comparison occurs within the comparator until the ROM output shifts to the new pattern through the sequence in the reverse direction. The comparator output signal is thus a series of periodic pulses of the test signal alternating current, that is, an on-off code with approximately 50% on-time or duty cycle. This coded or periodic alternating current output from the comparator is fed through a filter, rectifier decoding network to energize a vital DC track relay. Pickup of the track relay thus indicates a non-occupied track section but only when the correct comma-free track code word with the proper sequencing is received by the track receiver unit.

BRIEF DESCRIPTION OF THE DRAWINGS

Prior to defining my invention in the appended claims, I shall describe a specific arrangement of apparatus embodying the invention as illustrated in the accompanying drawings in which:

In each of the drawing figures, similar reference characters designate similar or the same parts of the apparatus or functions as appropriate

DESCRIPTION OF THE ILLUSTRATED EMBODIMENT

Figure 1:
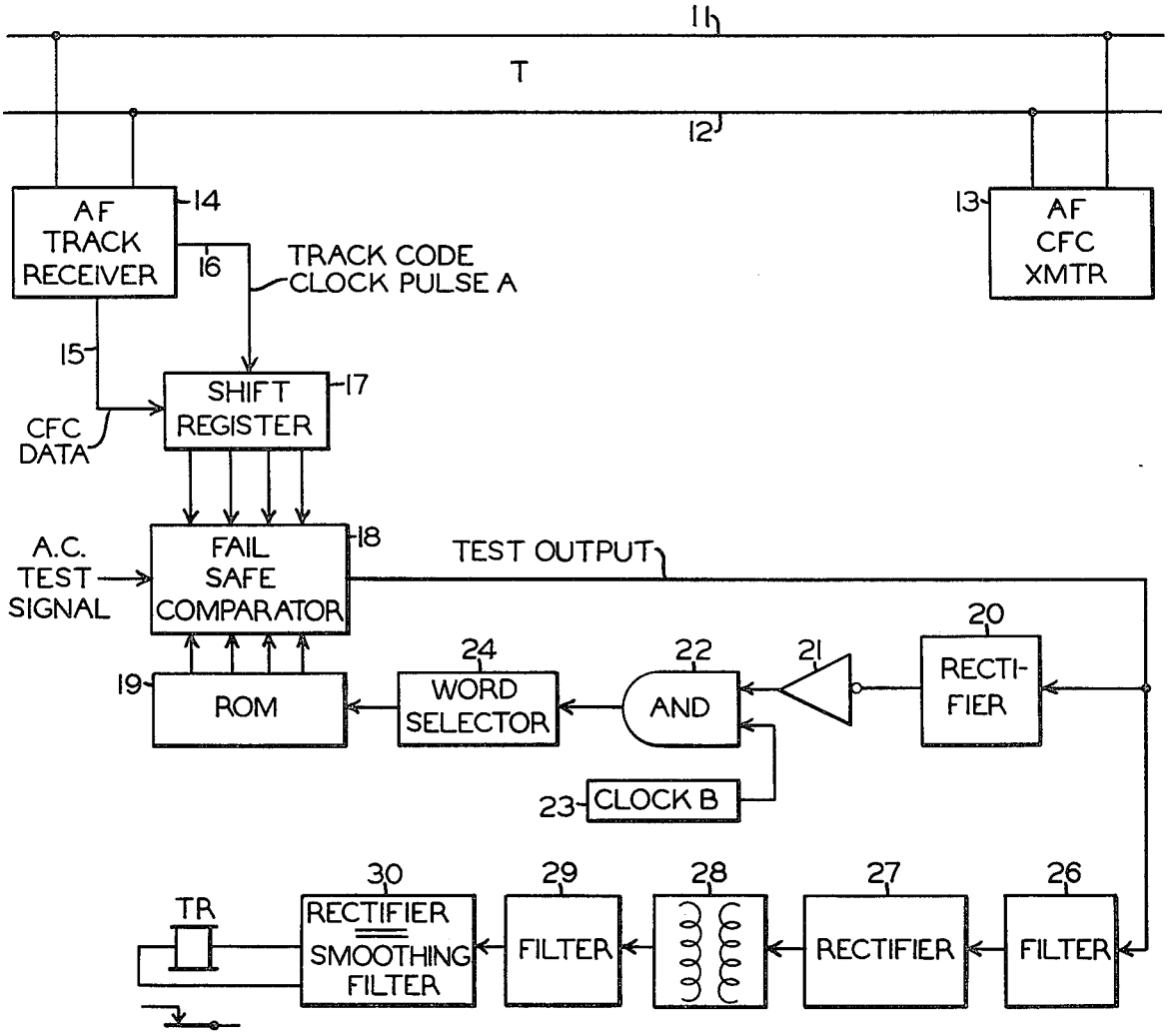
FIG. 1 is a block diagram illustration of a fail-safe decoder arrangement, for digital code railroad track circuits, embodying the invention.

Referring to FIG. 1, the two rails 11 and 12 of a railroad track section T are shown by conventional single lines. This section may be insulated or non-insulated from the remaining portion of the railroad track stretch, no insulated joints being here shown. Connected to the rails at the right end of the section is an audio frequency (AF) transmitter 13 designed to serially transmit pulses forming a digital commafree code (CFC) pattern. This transmitter is shown by a conventional block as the specific circuitry is not involved in the invention but merely is designed to generate pulses at the preselected audio frequency and transmit them in digital code form having a selected word pattern unique to this track section. The CFC words for all sections will have the same preselected bit length. Although a practical track circuit system will likely use words of ten-bit length in order to provide a reasonable number of unique code word patterns, for convenience and simplicity the diagram of FIG. 1 is based on a four-bit word length. At the other end of section T, an AF receiver unit 14, shown by conventional block, is connected across rails 11 and 12. The circuit details again are not critical but this receiver unit must be able to reconstitute at the data output line 15 the code bit sequence received through the rails and also produce, at its second output 16, clock pulses A equivalent to the transmitter clock pulses.

The digital output 15 of receiver 14 is supplied in serial fashion to a shift register 17 which is driven by the reproduced track clock pulses A. The shift register has a storage stage for each bit of the CFC word so that in the present showing four such stages are required as indicated by the four output lines from the bottom of the register block. The instantaneous digit storage in register 17 is applied in parallel format to one set of inputs of a fail-safe comparator unit 18, that is, to the upper four inputs of this conventionally shown block. Obviously, the input pattern of the track code changes with each clock pulse A as is schematically illustrated in the top line of the chart of FIG. 2 which shows the pattern shift of the four digits of the CFC word selected for this track section T. A second input to comparator 18 is received from a read-only-memory (ROM) unit 19 in which are stored CFC words, one for each possible bit pattern which the track code word may assume. The selected output word pattern, chosen in a manner to be discussed, is applied in parallel to the second inputs of the comparator.

Each pair of corresponding digits of the two input word patterns is separately compared within comparator 18. In other words, this unit has a comparator stage or cell for each bit of the track code word. An alternating current test signal applied to the highest order comparator cell, as indicated at the left of the conventional comparator block 18, is passed through the comparator cells to the output from the lowest order comparator cell only when each pair of the corresponding word digits compare, that is, are equivalent. This alternating current test signal is selected of a relatively high frequency so that it will not become confused or mixed with any of the frequencies used for the track circuit transmitters. Any known fail-safe comparator arrangement may be used but a specific example is disclosed in my compending application for U.S. patent Ser. No. 152,884, filed May 23, 1980, for a Fail-Safe Digital Comparator. If the comparator from this copending application is actually the one used, then the two inputs to be equivalent must have complementary characteristics, which requires that either the serial track data or the ROM output be inverted somewhere in the input networks. The term equivalent word pattern inputs, which actuate comparator 18 to pass the test signal to its output, thus covers both the corresponding word digit pairs having identical or complementary characteristics, in accordance with the type of comparator apparatus used.

The output signal from comparator 18 is supplied over one path to a full-wave rectifier 20. When full comparison within unit 18 is lacking, so that there is no test signal output, rectifier 20 produces no output, in effect, a 0 bit signal. This is converted by inverter 21 into a 1 signal at the upper input of the two-input AND gate 22. A second input to AND gate 22 is applied from clock pulse generator 23 which produces the clock pulses B. The frequency of pulses B is greater than that of clock pulses A with an approximate relationship indicated by the formula $$f_B = 2(n-2)f_A,$$

n being the number of bits in the CFC words. With a 1 bit input signal from inverter 21 actuating gate 22, each clock pulse B produces an output from the AND gate into selector 24 which, thus actuated, selects the next word pattern from the sequence stored in ROM 19. This action is schematically shown by the middle portion or line in the chart of FIG. 2. As long as the no-output condition from comparator 18 continues, the ROM 19 output is shifted with each clock pulse B. When an output signal from comparator 18 is applied to rectifier 20, the resulting output is inverted by unit 21 so that the AND gate receives a 0 bit input. Gate 22 is thus not activated so that the clock pulses are not passed. The word selection sequence by selector 24 halts and the ROm 19 output holds in its existing state.

Figure 2:
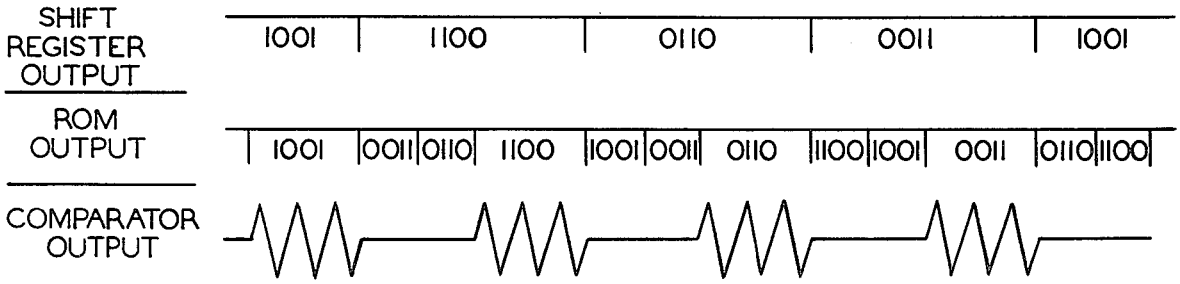
FIG. 2 is a schematic chart illustrating is stylized form the operation of the apparatus shown in FIG. 1.

It is to be noted in the chart of FIG. 2 that the pattern sequence of the code word searched out of ROM 19 is opposite to the sequence of the CFC word patterns received through the track rails and output from register 17. In other words, in the tope line of the chart, the digits in the track code shift to the right with each clock pulse A represented by the short vertical lines. Conversely, in the center line of the chart, the word selection sequence in ROM 19 is such that the word digits shift to the left with each clock pulse B, also represented by the short vertical lines, such shifts occurring only when AND gate 22 is primed by a 1 bit signal from inverter 21. It will be remembered that each of the digit patterns shown in the top two lines of FIG. 2 are different sequences of the same comma-free code word which is used to uniquely identify track section T. When the shift register output changes from the first to the second digit pattern shown in the upper chart, disagreement between the inputs to comparator 18 results in no output signal from rectifier 20. Through inverter 21, gate 22 is primed and the next clock pulse B causes selector 24 to choose the next word pattern in the memory 19 for application to comparator 18. This is the first shift shown at the left in the center line of the chart. Since the memory shift sequence is in the reverse order, the next word pattern also does not agree with the shift register input. AND gate 22 thus remains primed so that the next pulse from clock B also actuates selector 24 to choose a new pattern. With the illustrated four-digit word, the chart shows three shifts in the ROM output sequence before agreement again occurs between the shift register and ROM input to comparator 18. The comparator then passes the input test signal to the output line as indicated by the pulse output from the comparator illustrated in stylized form in the bottom line of the chart of FIG. 2. This pattern of shift and search continues so that the output signal from comparator 18 is a series of alternating current pulses at the test signal frequency with approximately a 50% duty cycle or on-time. This continuous output code pattern continues as long as section T is unoccupied by a train, so that the track code is received by track receiver 14, and no fault occurs in any of the apparatus involved.

One reason for the backward or reverse search through the ROM patterns is that such a search through all the possible words here stored in accomplished in about one-half the time interval between pulses of clock A. Thus, when a train clears a track section, a valid non-occupied indication may be obtained with $(n+0.5)$ periods of the clock pulses A, where n is the number of bits in the code word. Another consequence of this reverse search pattern is that the comparator output is an alternating current signal of a pulsating nature, present half the time and absent half the time. This signal can then be passed through a high frequency, narrow band filter to recognize the comparator output test signal frequency, rectified, and then passed through a low frequency, narrow band filter to recognize the pattern of alternate search and validity. This double filtering process has great integrity and fail-safeness and the low frequency output can then be processed through a capacitor or transformer, rectified, and used to energize the track relay. As previously noted, the rate of the clock pulses B is faster than that of clock pulses A and need not be synchronized with it. In the case of four-bit words here illustrated, the frequency of clock B is four times the frequency of clock A. A general relationship between the two clock frequencies has been previously defined but small departures from the relationship produce only small changes in the duty cycle of a valid output signal.

The decoding process with filtering and rectification is shown conventionally across the bottom of FIG. 1. The output of comparator 18 is applied to a filter 26 which is a high frequency, narrow band filter tuned to the test signal frequency in order to recognize and pass the comparator output pulses. The filter output is rectified by a fullwave rectifier 27 and the resulting direct current pulses are passed through an isolating transformer 28, shown schematically. The output of transformer 28 is then a low frequency square wave which is applied to and passed by filter 29 which is a low frequency, narrow band filter tuned to the code pattern frequency of the output pulses to recognize the pattern of alternate search and comparison for validity. The filter 29 output is rectified and smoothed by device 30 and the resulting direct current used to energize track relay TR which is of the direct current vital type. Relay TR is thus energized only when the correct digital code is received through the rails of section T by receiver 14 and verified by the comparator. This reception is further verified as to correct pattern by the alternate search and validity checks performed by the associated filter/rectifier apparatus which processes the pulse output from comparator 18.

When a train shunts the rails of the track section, shift register 17 will contain a valid word which it holds during the train occupancy since no further lock pulses are received. During the whole occupancy period, the comparator will have a valid and continuous output since there is no shifting of the register output. Hence there will be no search during this time, no pulsating output from comparator 18, and no low frequency square wave from transformer 28 in te decoding network. Relay TR is thus deenergized and releases to register the track occupancy condition.

Many possible system failure modes are dealt with directly by the fail-safe comparator 18. A track defect which allows a correct word pattern to be infrequently received will produce a comparator operation which is mostly a search condition. Hence the on-time of the comparator output is low and the frequency of the square wave from transformer 28 will be so low that insufficient energy is present to hold track relay TR energized and picked up. Other fault conditions may result in some of the words in ROM 19 being changed into other words which conceivably might be the proper ones to decode some other track transmitter associated with a nearby track section. However, it is reasonable to assume that such changes in the ROM storage are rare and that there is no failure mechanism that can cause simultaneous failures in a large portion i. e., more than 50%, of the stored words. Further assuming correct track code reception by receiver 14, the on-time or duty cycle of the computer output is reduced, as the ROM words are changed, since the shift register output is being compared against code word patterns that are improper. Less and less direct current voltage thus appears across relay TR so that its release eventually occurs due to the fault condition. For example, if one-half of the ROM word storage is incorrect, the voltage applied to the track relay is reduced to about one-half of its normal operating level. If we assume that these changed ROM 19 words constitute a series appropriate to a nearby track transmitter, whose output may be inadvertently received by receiver 14, relay TR can possibly receive up to half operating voltage due to the wrong transmitter, even with section T occupied by a train. Since it is believed that no failure or fault can cause more than 50% of the ROM word storage to change, if the relay can be guaranteed to drop out at 60% of operating voltage, then a safe condition exists. However, further assurance of safe operation may be provided if the relay is preceded by a level detector which can be guaranteed to provide no relay drive output at less than the 60% level.

The arrangement of the invention thus provides a fail-safe decoder for digital track circuits. Each comma-free word pattern received through the rails is compared with locally stored word patterns of the proper word for that section selected in the reverse sequence to the track code shift. This produces pulsed output signals from the comparator which may be vitally decoded by a filtering and rectification process to control a vital track relay. The resulting arrangement reliably assures that only when the proper digital track code word is received is a non-occupied track indication registered. The equipment used in minimal so that an efficient and economical arrangement results.

Although I have herein shown and described but a single arrangement of fail-safe decoder apparatus for a digital track circuit, it is to be understood that various changes and modifications within the scope of the appended claims may be made to the apparatus without departing from the spirit and scope of my invention.

Having thus described the invention, what I claim as new and desire to secure by Letters Patent, is:

1. Track circuit apparatus for a section of railroad track, comprising, (a) transmitter means coupled to the rails at one end of said section for continuously transmitting through said rails a preselected unique sequential digital track code of selected length to detect the occupancy condition of and to identify said section, (b) register means coupled to said rails at the other end of said section for sequentially registering the digital code received when the section is unoccupied by a train and continuously producing a parallel output of the existing registered code pattern, (c) memory means operable for supplying in parallel format a digital code output selected from a plurality of stored digital codes, one for each possible different pattern of said unique track code, (d) comparator means coupled to said register means and said memory means for comparing the parallel output code patterns, (e) a test signal source coupled for supplying a test signal input of predetermined characteristics to said comparator means, (f) said comparator means responsive only to equivalent input code patterns from said register means and memory means for producing a test signal output, (g) selector means coupled to said memory means and controlled by said comparator means for selecting in a predetermined sequence the stored code pattern output by said memory means when an output test signal is not produced, and (h) output means coupled to said comparator means and responsive only to periodic output test signals for registering an unoccupied track section indication.

2. Track circuit apparatus as defined in claim 1 in which said register means comprises, (a) a track receiver coupled to said rails and responsive to the received track code for separately producing sequential code digits of said track code and reconstituted transmitter clock pulses, and (b) a shift register coupled to said track receiver and controlled by said reconstituted clock pulses for sequentially registering said track code digits and responsive for providing a continuous parallel digital output of the existing registered pattern to said comparator means.

3. Track circuit apparatus as defined in claim 2 in which said selector means comprises, (a) detector means coupled to said comparator means for providing a signal only when the absence of comparator means output is detected, (b) a source of other clock pulses having a frequency which is a predetermined multiple of said reconstituted clock pulse frequency.

(c) an AND gate coupled to said detector means and said other clock pulse source for passing said other clock pulses only when a detector means signal is present, and (d) a word selector coupled to said memory means and controlled by each output pulse of said AND gate for actuating a shift of said memory means output to the next word pattern in said predetermined sequence.

4. Track circuit apparatus as defined in claim 1, 2, or 3 in which, said digital track code is of the comma-free code type having a preselected word length transmitted sequentially through said rails in continuously repeating patterns.

5. Track circuit apparatus as defined in claim 4 in which, (a) said predetermined sequence of selecting memory means output patterns is the reverse of the digital track code pattern shift for actuating cycles of alternate search and compare actions by said comparator means, and (b) said comparator means is responsive to said alternate search and compare action cycles for producing a periodic test signal output having substantially a 50% duty cycle.

6. Track circuit apparatus as defined in claim 5 in which, (a) said digital code pulses are of alternating current within the audio frequency range, (b) said test signal characteristic is an alternating current having a selected frequency above the audio range, and in which said output means includes, (c) a first filter and rectifier network tuned to said test signal frequency for converting the periodic comparator test signal output into direct current pulses at the periodic rate of said search and compare action cycles, (d) a transformer coupled for converting said first filter-rectifier output pulses into a low frequency square wave alternating current, (e) a second filter and rectifier network tuned to the low frequency of said square wave alternating current and coupled to said transformer for producing a direct current output, and (f) a relay coupled to said second filter-rectifier network for registering an unoccupied section indication only when said direct current output is present.

7. Decoding apparatus for registering the reception of a preselected length, unique, comma-free digital code word transmitted over a communication channel by a transmitter coupled at the remote end of that channel, comprising, (a) a receiver means coupled to said channel and responsive to the serial reception of the digital code for supplying a parallel digital output having the same number of digits as said preseleced word length, (b) a read only memory means for supplying a selected output from a stored plurality of parallel digital patterns corresponding to each possible digit pattern of the transmitted comma-free code word, (c) a comparator means coupled for comparing the outputs of said receiver means and said memory means and responsive only to equivalent digital code patterns for producing an output test signal having preselected characteristics, (d) a selector means coupled to said memory means and controlled by said comparator means for successively selecting in a predetermined sequence the stored code patterns when a test signal is not produced by said comparator means, and (e) output means coupled to said comparator means and responsive only to periodic output test signals for registering the reception of correct code words over said channel.

8. Decoding apparatus as defined in claim 7 in which said receiver means comprises, (a) a code receiver coupled to said channel and responsive to the received digital code for supplying a serial pulse output matching the received code bits and a reproduced clock pulse output equivalent to transmitter clock pulses, and (b) a shift register having a storage stage for each bit of the preselected code word length, coupled to said code receiver and controlled by said clock pulses for serially registering said serial pulse output, and (c) said shift register further coupled for continuously supplying the registered code bits as a parallel bit output to said comparator means.

9. Decoding apparatus as defined in claim 8 in which said selector means comprises, (a) a detector coupled for detecting the presence or absence of a test signal output from said comparator means and responsive for producing an output signal only when absence of the test signal is detected, (b) a clock unit operable to produce other clock pulses at a frequency which is a selected multiple of the frequency of said clock pulses reproduced, (c) an AND element coupled to said detector and said clock unit for passing said other clock pulses only when a detector output signal is present, and (d) a word selector coupled to said AND element and said read only memory means and responsive to each passed other clock pulse for selecting the next memory means output word pattern in a predetermined sequence.

10. Decoding apparatus as defined in claim 9 in which, (a) said predetermined sequence of selecting memory means output patterns is the reverse of the pattern shift in said comma-free digital code transmitted through said channel and (b) said comparator means is responsive to the opposite input pattern sequences for producing at a predetermined rate periodic output signals having said test signal characteristic.

11. Decoding apparatus as defined in claim 10 in which said output means comprises, (a) a first detector network coupled to said comparator means and responsive only to signals with said test signal characteristic for producing a pulsed direct current output signal at the periodic rate of said comparator means output signals, (b) a second detector network responsive only to an alternating signal at said predetermined periodic rate for producing a direct current output signal, (c) a coupling means connected for converting said pulsed output signal of said first network into an alternating signal at said predetermined rate and applying that signal to said second network, and (d) a register relay coupled to respond to said direct current output of said second network for registering the reception of the correct digital code word over said channel.

12. Decoding apparatus as defined in claim 11, in which, (a) said communication channel comprises the two rails of a railroad track section, (b) said transmitter is coupled to the rails at the remote end of said section and transmits the comma-free code at a selected audio frequency, and (c) said code receiver is coupled to the rails at the other end of said section and is responsive to receive only code pulses of said selected audio frequency.

13. Decoding apparatus for a digital code track circuit, in which a unique digital code of preselected word length is sequentially received at one end of a corresponding track section from a transmitter coupled to the section rails at the other end, comprising, (a) receiver means coupled to the rails at said one end and responsive to the received digital code for producing corresponding sequential code pulses and reconstituted transmitter clock pulses, (b) a shift register means operable for storing digital words of said preselected length, coupled to said receiver means and controlled by said reconstituted clock pulses for serially registering the sequential code pulses, (c) comparator means coupled to said register means for receiving in parallel the registered code word digits whose pattern shifts with each reconstituted clock pulse, (d) a memory means storing a plurality of digital codes, one for each possible different pattern of the unique track section code and coupled for supplying a selected code pattern to said comparator means, (e) a selection means coupled to said comparator means and said memory means and responsive to the absence of any output from said comparator means for supplying to said comparator means in a predetermined sequence the codes stored in said memory means, (f) said comparator means also coupled to a source of a test signal having a preselected characteristic and responsive only to periods of equivalent code inputs from said register means and memory means for producing periodic output signals corresponding to said input test signal, and (g) a filter-rectifier network coupled to said comparator means and responsive only to periodic output signals having said test signal characteristic for registering an unoccupied track section indication.

* * * * *